United States Patent [19]

Martin

[11] Patent Number: 4,912,888

[45] Date of Patent: Apr. 3, 1990

[54] GUTTER CONSTRUCTION

[76] Inventor: Charles L. Martin, 1213 Royal, Royal Oak, Mich. 48073

[21] Appl. No.: 172,761

[22] Filed: Mar. 28, 1988

[51] Int. Cl.[4] ..... G04D 13/06

[52] U.S. Cl. ..... 52/12; 52/11; 52/95; 405/119

[58] Field of Search ..... 52/11–16, 52/95; 405/119; 210/474; 248/48.1, 48.2

[56] References Cited

U.S. PATENT DOCUMENTS

| | | | |
|---|---|---|---|
| 2,761,642 | 9/1956 | Rachlin | 248/48.1 |
| 3,300,911 | 1/1967 | Riddell | 52/16 |
| 3,740,787 | 6/1973 | Bowermaster | 52/12 X |
| 3,874,131 | 4/1975 | Webster | 52/11 |
| 4,254,595 | 3/1981 | Crosslen | 52/11 |
| 4,407,097 | 10/1983 | Allen | 52/11 |
| 4,446,658 | 5/1984 | Gouin | 52/11 |
| 4,493,588 | 1/1985 | Duffy | 405/119 |
| 4,669,232 | 6/1987 | Wyatt | 52/11 |

*Primary Examiner*—Carl D. Friedman

*Assistant Examiner*—Lan Mai

*Attorney, Agent, or Firm*—Reising, Ethington, Barnard, Perry & Milton

[57] ABSTRACT

A gutter device (10) for capturing and channeling run-off rain water from a roof (12). The gutter device (10) comprises a vertical back wall (16), a bottom wall (18) extending outwardly from the back wall (16) and a front wall (20) extending upwardly from the bottom wall (18) to define a generally U-shaped trough portion (14). A hinge (24) is provided at the intersection (22) of the bottom wall (18) and the front wall (20) for allowing the front wall (20) to rotate the trough portion (14) to an open position. A lip portion (42) extends rearwardly of the back wall (16) for insertion underneath the shingles along the roof edge. A perforated top wall (16) extends between the front wall (20) and the back wall (16), and includes a downwardly extending male leg (34) which interlocks with a female channel (36) disposed on the back wall (16). A drip edge (40) extends outwardly from the back wall (16).

17 Claims, 4 Drawing Sheets

GUTTER CONSTRUCTION

TECHNICAL FIELD

This invention relates generally to gutter devices extending along the bottom edge of sloped roofs. More specifically, the subject invention is directed toward a gutter device having a hinge extending longitudinally thereof for allowing the gutter to rotate to an open position.

BACKGROUND ART

Gutter devices adapted for rotating out of the water channeling position to an open position are known in the prior art. The U.S. Pat. No. 4,446,658 to Gouin, issued May 8, 1984, discloses a hinged gutter construction adapted for folding underneath the horizontal eve surface of a building. One embodiment of the Gouin gutter device includes rigid structural walls defining a generally U-shaped trough portion and a hinge is disposed on the vertical back wall.

The Gouin gutter device is deficient in that the downspout pipes which conduct water to the ground must be removed prior to rotating open the gutter device. This results from the hinge being located on the vertical back wall which causes the entire bottom wall to rotate about the hinge. Because the down-spouts adjoin the gutter device at the bottom wall, disconnection of the downspout pipe and the bottom wall is necessary prior to rotating the gutter open. This disconnection is extremely impractical as the down-spout pipes are usually attached to the building. Additionally, the gutter device shown in Gouin requires a horizontal eve surface for sheltering and supporting the gutter device when rotated open. It will be readily appreciated that not every building includes a horizontal eve surface adjacent the roof edge. Therefore, in addition to the down-spout disconnection problem, the Gouin gutter is not versatile for adaptation to a wide variety of building eve designs.

SUMMARY OF THE INVENTION AND ADVANTAGES

The subject invention provides a gutter device adapted to extend along the edge of a roof. The gutter device comprises a rigid elongated trough portion supported in a water channeling position for channeling water longitudinally of the device, the trough portion including a back wall adapted for mounting adjacent the roof edge, and a hinge means disposed on the trough portion and extending longitudinally of the gutter device for allowing the trough portion to rotate out of the water channeling position. The gutter device is characterized by the hinge means defining a hinge axis spaced outwardly from the back wall a fixed distance.

The outwardly spaced hinge axis of the hinge means of the subject invention provides a gutter device which may receive a plurality downspouts between the back wall and the hinge axis so that the down-spouts do not require removal when the trough portion is rotated out of the water channeling position. Additionally, the gutter device can be mounted adjacent any roof edge irrespective of the architectural design of the building's eve surfaces.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the figures, wherein like numerals indicate like or corresponding parts throughout the several views, a gutter device is generally shown at 10. The gutter device 10 is adapted to extend along the edge of a roof, generally indicated at 12 in FIGS. 3 and 4.

Figure 3:
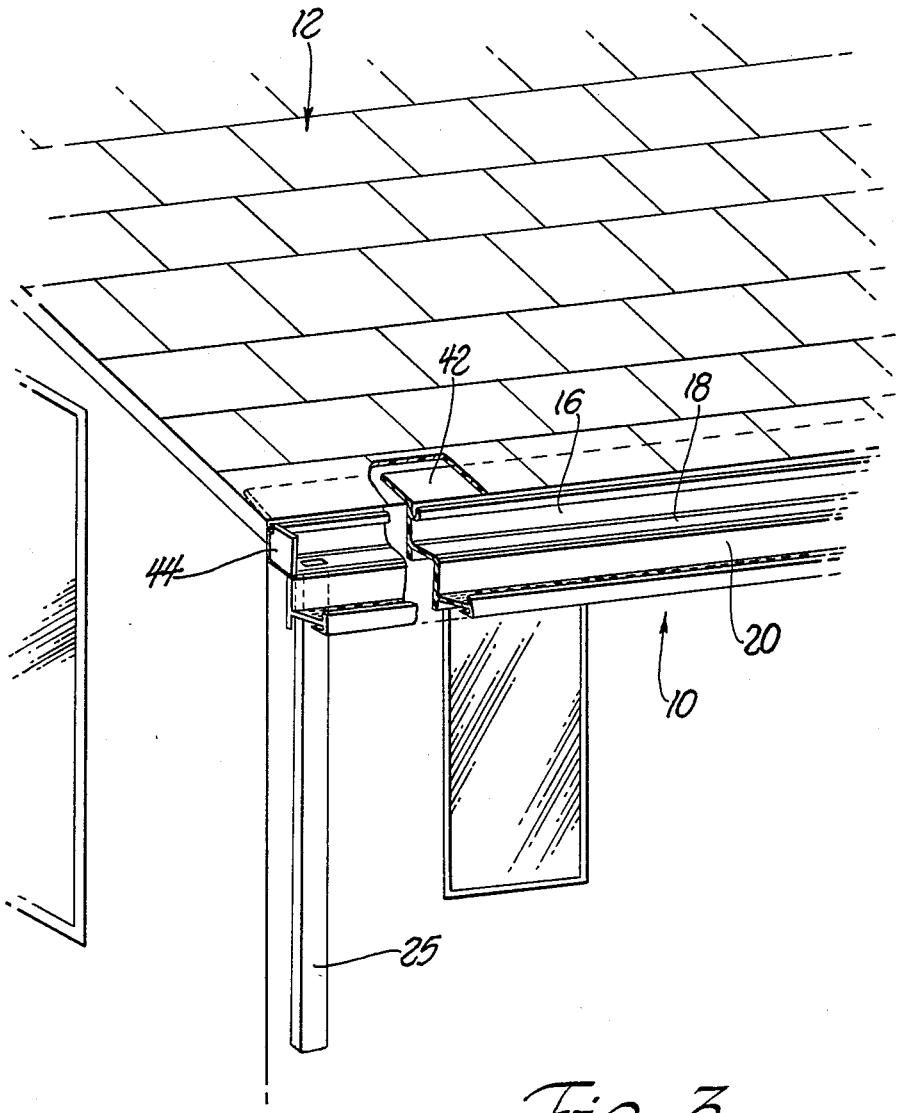
FIG. 3 is an environmental view of the subject invention with the trough portion shown rotated out of the water channeling position.
Figure 4:
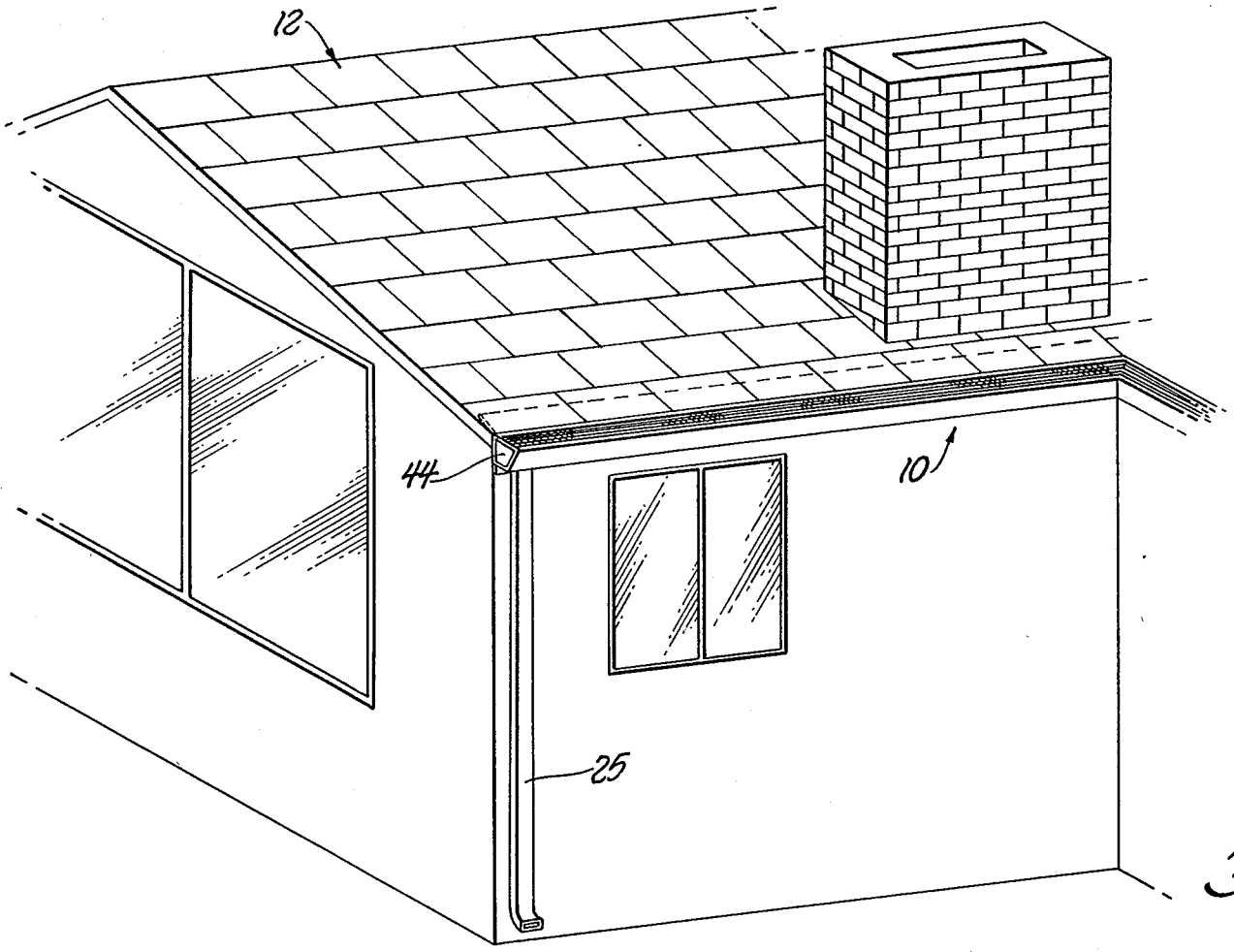
FIG. 4 is an environmental view of the subject invention with the trough portion shown in the water channeling position.

The gutter device 10 includes a rigid elongated trough portion, generally indicated at 14, which is supported in a water channeling position for channeling water longitudinally of the gutter device 10. The trough portion 14 has a generally U-shaped cross section extending the length of the device 10. More specifically, the trough portion 14 includes a back wall 16 adapted for mounting adjacent the roof edge. That is, the outer surface of the back wall 16 abuts the vertical face of the roof edge, as shown in FIGS. 3 and 4. The trough portion 14 also includes a generally horizontal bottom wall 18 extending outwardly from the lower end of the back wall 16 in a fixed cantilevered fashion, and a front wall 20 adjoining the bottom wall 18 to define an intersection 22 spaced outwardly from an extending parallel with the back wall 16. The front wall 20 extends upwardly from the intersection 22. In other words, the generally U-shaped trough portion 14 comprises a generally vertical back wall 18 mounted adjacent the roof edge, a generally horizontal bottom wall 18 extending outwardly from the lower end of the back wall 16, and a front wall 20 extending upwardly from the bottom wall 18 to define a water channeling position, as shown in FIG. 1.

Figure 2:
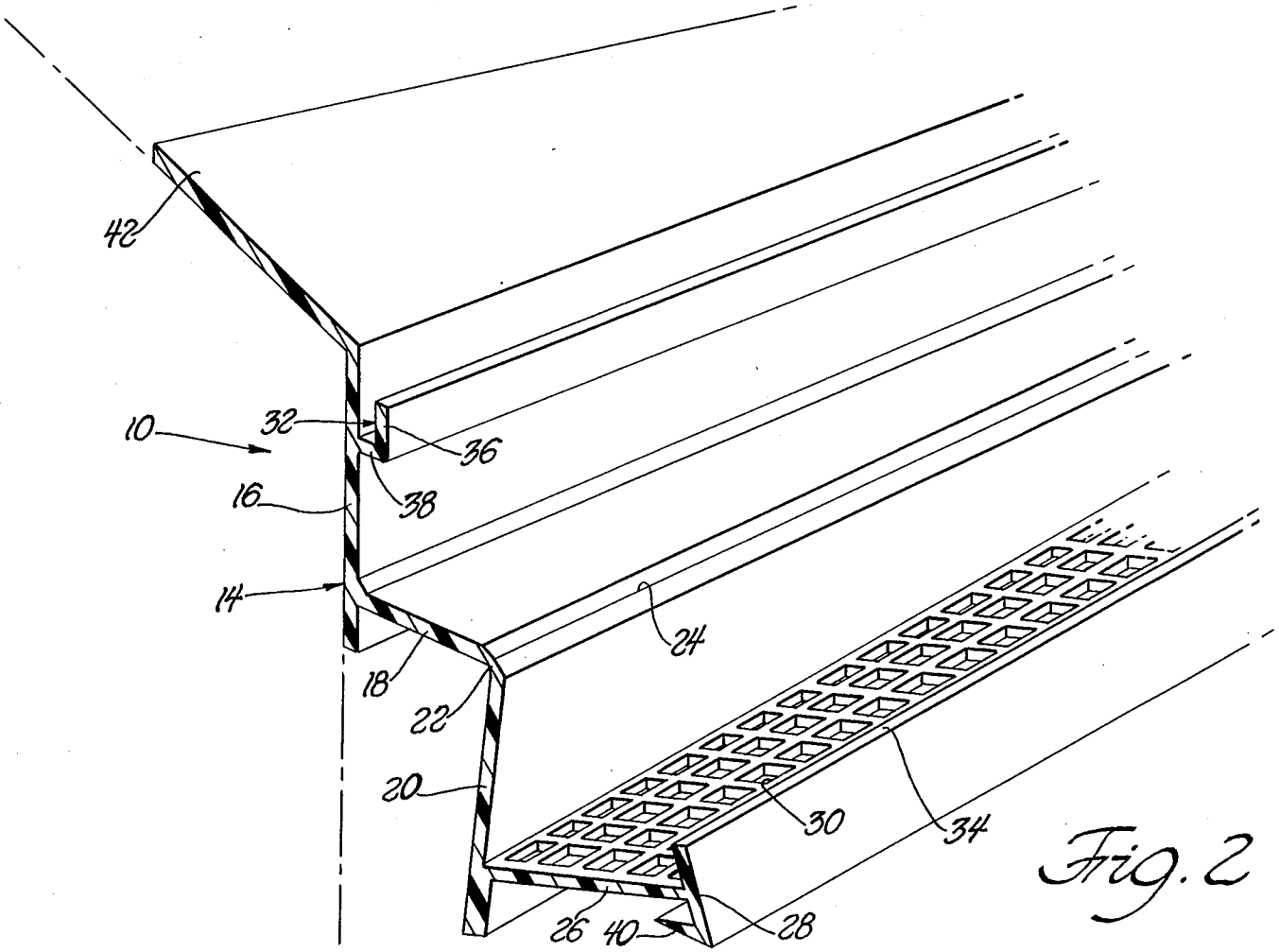
FIG. 2 is a perspective view of the subject invention shown with the trough portion rotated out of the water channeling portion.

A hinge means 24 is disposed on the trough portion 14 and extends longitudinally of the gutter device 10 for allowing the trough portion 14 to rotate out of the water channeling position, as shown in FIG. 2 The subject invention is characterized by the hinge means 24 defining a hinge axis spaced outwardly from the back wall 16 a fixed distance. That is to say, the hinge axis of the hinge means 24 is spaced away from the back wall 16 for allowing the front wall and top wall of the trough portion 14 to rotate out of the water channeling position as a unit without requiring a down-spout pipe 25, attached to the bottom wall 18 between the back wall 16 and the hinge means 24, to be removed.

Preferably, the intersection 22 between the bottom wall 18 and the front wall 20 defines the hinge axis of the hinge means 24. In this manner, the down-spout 25 may be connected anywhere along the bottom wall 18, so that the trough portion 14 may be rotated out of the water channeling position while the down-spout pipe 25 remains attached to the gutter device 10. In the preferred embodiment, the down-spout pipe 25 extends downwardly from the bottom wall 18 betWeen the back Wall 16 and the hinge axis.

Figure 1:
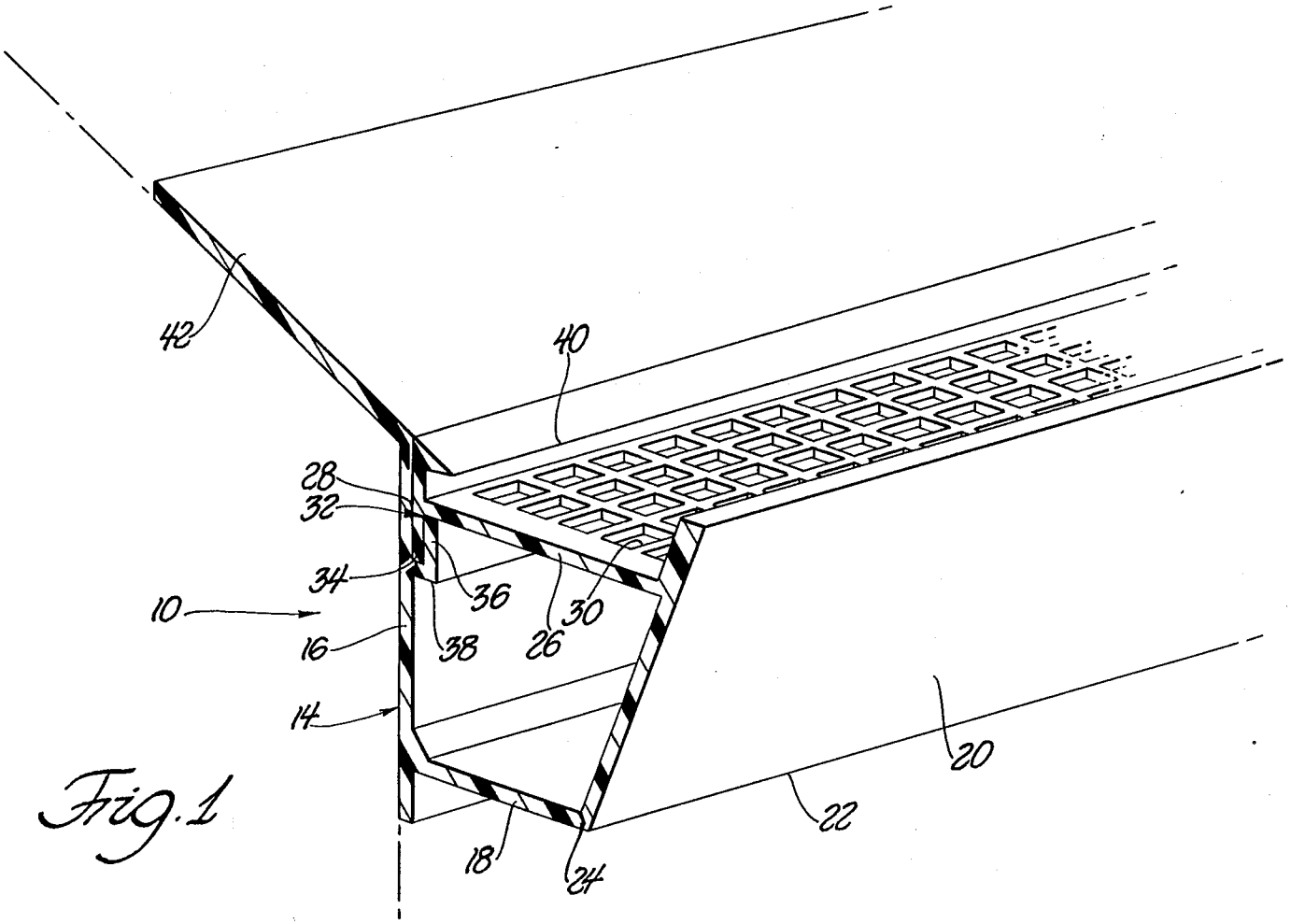
FIG. 1 is a perspective view of the preferred embodiment of the subject invention with the trough portion shown in the water channeling position.

As shown in FIG. 1, a perforated top wall 26 is disposed between the front wall 20 and the back wall 16, and is spaced upwardly from the bottom wall 18. The perforated top wall 26 is generally parallel with the bottom wall 18 when the trough portion 14 is maintained in the water channeling position. The perforated top wall 26 extends continuously longitudinally of the gutter device 10 and serves as a screen for preventing large debris and insects from entering the trough portion 14 when in the water channeling position. The perforated top wall 26 is integral with the front wall 20 and extends inwardly therefrom to a distal end 28. The distal end 28 of the perforated top wall 26 extends straight and parallel of the back wall 16. In the preferred embodiment, a plurality of symmetrically spaced square apertures 28 extend through the perforated top wall 26 for allowing water to pass through, but screening debris such as leaves, twigs, animals, and large insects.

The gutter device 10 includes locking means, generally indicated at 32, for maintaining the trough portion 14 in the water channeling position. The locking means 32 extend from the back wall 16 for connection to the front wall 20. More specifically, the locking means 32 are disposed between the distal end 28 of the perforated top wall 26 and the back wall 16. The locking means 32 comprise interlocking elements 34, 36. One of the interlocking elements 34 is disposed on the distal end 28 of the perforated top wall 26 adjacent the back wall 16 and the other interlocking element 36 is disposed on the back wall 16 adjacent the perforated top wall 26.

Referring to FIGS. 1 and 2, the locking means 32 comprise a male leg 34 extending perpendicularly downwardly from the distal end 28 of the perforated top wall 26, and an L-shaped arm 38 extending perpendicularly outwardly from and upwardly parallel to the back wall 16 forming a female channel 36 for receiving the male leg 34. That is to say, when the trough portion 14 is in the water channeling position, the male leg 34 extending perpendicularly downwardly from top wall 26 is matingly received in the female channel 36 which is secured to the back wall 16. In this manner, the trough portion 14 is effectively prevented from rotating out of the water channeling position. The male leg 34 and female channel 36 coextend continuously longitudinally of the gutter device 10.

A drip edge 40 extends continuously longitudinally of the gutter device 10 adjacent the roof edge and projects outwardly from the back wall 16. That is to say, when the trough portion 14 is in the water channeling position, the drip edge 48 extends outwardly from the roof edge so that run-off water will be carried away from the roof edge prior to falling into the trough portion 14 for preventing the run-off rain water from adhering to the shingle edges and running underneath in accordance with the Coanda effect. The drip edge 40 is integral with the perforated top wall 26 and has a generally L-shaped cross section extending perpendicularly upwardly from the distal end 28 and outwardly parallel to the perforated top wall 26. As perhaps best shown in FIGS. 1 and 2, the portion of the drip edge 40 which extends outwardly from the roof edge has a wedge or knife edge shape for facilitating water projection thereover.

The gutter device 10 includes a lip portion 42 extending rearwardly of the back wall 16 and adapted for insertion underneath a roof covering, e.g., shingles, along the roof edge. As shown in the figures, the lip portion 42 extends continuously longitudinally of the device 10. The lip portion 42 angularly intersects the back wall 16 at a predetermined angle equivalent to the average slope of residential roofs 12. As will be described subsequently, the gutter device 10 is preferably fabricated from a plastic material, which allows the lip portion 42 to be angularly flexed from the back wall 16 in order to correspond with any given roof 12 slope.

The lip portion 42 is provided for supporting the gutter device 10 adjacent the roof edge. In practice, the lip portion 42 is inserted underneath the shingles along the roof edge, and roofing nails or other suitable fasteners are driven through the shingles and lip portion 42 and into the structural roof boards. In this manner, conventional gutter hangers and gutter spikes are eliminated.

The gutter device 10 includes a plug means 44 having a periphery conforming to the internal cross section of the trough portion 14 when in the water channeling position for preventing the movement of water therepast. More specifically, the plug means 44 may comprise any type of device which prevents water from moving therepast. However, it is preferred that the plug means 44 be of such construction so as to allow the trough portion 14 to rotate about the hinge axis of the hinge means 24 without disconnecting or removing the plug means 44. As shown in FIGS. 3 and 4, the plug means 44 may take the form of an end insert for disposition at the end of a length of gutter 10.

The gutter device 10 is fabricated in one unitary piece from a homogeneous plastic material. As such, the gutter device 10 is integrally formed by an extrusion type manufacturing process. That is to say, the gutter device 10 is extruded in one integral piece through a die having an extrusion aperture which may resemble the cross sectional shape of the gutter device 10 as shown in FIG. 2.

The hinge means 24 is integral with the bottom wall 18 and the front wall 20. By integrally forming the gutter device 10 from a homogeneous plastic material, it will be appreciated that the hinge means 24 will be unitary with the bottom wall 18 and the front wall 20. This is particularly advantageous for the prevention of water leaks through the hinge means 24.

As best shown in FIG. 2, the edges of the bottom wall 18 and front wall 20 adjacent the hinge means 24 are beveled into the hinge axis of the hinge means 24 for allowing the front wall 20 to rotate the trough portion 14 into the water channeling position without impinging upon one another. Said another way, the edges of the bottom 18 and front 20 walls adjacent the hinge means 24 are angled to form complementary angles which are contiguous when the trough portion 14 is in the water channeling position.

In many applications, it will be necessary to provide connector means for connecting two gutter devices 10 together in either end-to-end fashion or around corner fashion. In such situations, the connector means (not shown) preferably comprise a hollow sleeve type member having a periphery conforming to the internal cross section of the trough portion 14 for slideable insertion into the end of the trough portion 14 of each gutter device 10 to be coupled. That is to say, the sleeve-like connector means may be of any necessary contour to conform to building corners and the like, and is slideable into the trough portion 14 of a gutter device 10 to connect one such gutter device 10 to another gutter device 10 for allowing the communal channeling of water between the two.

In use, the trough portion 14 may be rotated to the open position to clean the gutter device 10 from a ground position, such as by using the water spray from a garden hose, for convenient cleaning without removing the down-spouts 25 prior thereto. Additionally, the person may deem it prudent to rotate open the trough portion 14 during Winter months for preventing ice build-up in the gutter device 10, which otherwise may lead to water seepage underneath the shingles, ultimately entering the building and damaging the interior.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A gutter device (10) adapted to extend along the edge of a roof (12) comprising: a rigid elongated trough portion (14) supported in a water channeling position for channeling water longitudinally of said device (10), said trough portion (14) including a planar back wall (16) adapted for mounting adjacent the roof edge, a generally horizontal bottom wall (18) extending outwardly from said back wall (16) in a fixed cantilevered fashion, a front wall (20) adjoining said bottom wall (18) to define an intersection (22) spaced outwardly from and extending parallel with said back wall (16), said front wall (20) extending upwardly from said intersection (22), a perforated top wall (26) disposed between said front wall (20) and said back wall (16) and spaced upwardly from said bottom wall (18); a hinge means (24) disposed on said trough portion (14) extending longitudinally of said device (10) for allowing said top wall and front wall to rotate into an open position out of the water channeling position as a rotating unit and to freely remain in said open position; said device (10) characterized by said hinge means (24) defining a hinge axis spaced outwardly from said back wall (16) a fixed distance; and locking means (32) disposed on said planar back wall (16) and extending outwardly therefrom for connecting to said unit for maintaining said trough portion (14) in said water channeling position.

2. A device (10) as set forth in claim 1 further characterized by said intersection (22) between said bottom wall (18) and said front wall (20) defining said hinge axis.

3. A device (10) as set forth in claim 2 further characterized by said perforated top wall (26) extending continuously longitudinally of said device (10).

4. A device (10) as set forth in claim 2 including a down-spout means (25) extending from said bottom wall (18) between said back wall (16) and said hinge axis.

5. A device (10) as set forth in claim 3 further characterized by said perforated top wall (26) being integral with said front wall (20) and extending inwardly therefrom to a distal end (28) and generally parallel with said bottom wall (18).

6. A device (10) as set forth in claim 3 further characterized by including a drip edge (40) extending continuously longitudinally of said device (10) adjacent the roof edge and projecting outwardly from said back wall (16).

7. A device (10) as set forth in claim 5 further characterized by said locking means (32) disposed between said distal end (28) of said top wall (26) and said back wall (16) comprising interlocking elements (34, 36), one of said interlocking elements (34) being disposed at said distal end (28) of said perforated top wall (26) adjacent said back wall (16) and the other of said interlocking elements (36) being disposed on said back wall (16) adjacent said top wall (26).

8. A device (10) as set forth in claim 6 further characterized by said drip edge (40) being integral with said perforated top wall (26) and having a generally L-shaped cross section extending perpendicularly upwardly from said distal end (28) and outwardly parallel to said perforated top wall (26).

9. A device (10) as set forth in claim 6 further characterized by including a lip portion (42) extending rearwardly of said back wall (16) and adapted for insertion underneath a roof covering along the roof edge.

10. A device (10) as set forth in claim 7 further characterized by said interlocking elements (34, 36) comprising a male leg (34) extending perpendicularly downwardly from said perforated top wall (26), and an L-shaped arm (38) extending perpendicularly outwardly from and upwardly parallel to said back wall (16) forming a female channel (36) for receiving said male leg (34).

11. A device (10) as set forth in claim 9 further characterized by said lip portion (42) extending continuously longitudinally of said device (10).

12. A device (10) as set forth in claim 9 further characterized by including plug means (44) having a periphery conforming to the internal cross section of said trough portion (14) when in the water channeling position for preventing the movement of water therepast.

13. A device (10) as set forth in claim 10 further characterized by said male leg (34) and said female channel (36) coextending continuously longitudinally of said device (10).

14. A device (10) as set forth in either of claims 2 or 12 further characterized by said hinge means (24) being integral with said bottom wall (18) and said front wall (20).

15. A device (10) as set forth in claim 14 further characterized by being integrally formed by an extrusion type manufacturing process.

16. A device (10) as set forth in claim 15 further characterized by being fabricated from a homogeneous plastic material.

17. A gutter device (10) adapted to extend along the edge of a roof (12) comprising: a planar generally vertical back wall (16) adapted for mounting adjacent the roof edge; a bottom wall (18) extending outwardly in a generally horizontal plane from said back wall (16) in a fixed cantilevered fashion; a front wall (20) adjoining said bottom wall (18) to define an intersection (22) spaced outwardly from and extending parallel with said back wall (16), said front wall (20) extending upwardly from said intersection (22); a hinge (24) defined by an axis disposed along said intersection (22) between said bottom wall (18) and said front wall (20) extending continuously longitudinally of said device (10); a perforated top wall (26) generally parallel with and spaced upwardly from said bottom wall (18) extending inwardly from said front wall (20) in cantilevered fashion to a distal end (28) adjacent said back wall (16); male (34) and female (36) interlocking elements, one of said interlocking elements (34) being disposed on said distal end (28) of said perforated top wall (26) and the other of said interlocking elements (36) being disposed on said planar back wall (16) extending outwardly therefrom toward said front wall (20) and adjacent said distal end (28); a drip edge (40) extending continuously longitudinally of said device (10) and projecting outwardly from said back wall (16); a lip portion (42) extending continuously longitudinally of said device (10) and rearwardly from said back wall (16); said hinge (24) allowing said front wall (20) to rotate in an arcuate direction relative to said bottom wall (18) such that said male (34) and female (36) interlocking elements move away from each other and freely remaining in an open position whereby said male (34) and female (36) interlocking elements freely remain spaced apart.

* * * * *